US010524987B1

(12) United States Patent
Almarzooqi et al.

(10) Patent No.: US 10,524,987 B1
(45) Date of Patent: Jan. 7, 2020

(54) SMART BABY BOTTLE TO PREVENT TOOTH DECAY IN INFANTS

(71) Applicant: United Arab Emirates University, Al Ain (AE)

(72) Inventors: Ali Almarzooqi, Al Ain (AE); Amir Almarzooqi, Al Ain (AE)

(73) Assignee: UNITED ARAB EMIRATES UNIVERSITY (AE)

( * ) Notice: Subject to any disclaimer, the term of this patent is extended or adjusted under 35 U.S.C. 154(b) by 0 days.

(21) Appl. No.: 16/228,046

(22) Filed: Dec. 20, 2018

(51) Int. Cl.
*A61J 9/00* (2006.01)
*A61J 11/00* (2006.01)
*A61J 11/04* (2006.01)

(52) U.S. Cl.
CPC ..... *A61J 9/00* (2013.01); *A61J 11/002* (2013.01); *A61J 11/04* (2013.01); *A61J 2200/76* (2013.01)

(58) Field of Classification Search
CPC ..... A61J 9/00; A61J 2200/70; A61J 2200/76; A61J 11/002; A61J 11/04; A61J 7/0046; A61J 9/008
See application file for complete search history.

(56) References Cited

U.S. PATENT DOCUMENTS

| | | | | | |
|---|---|---|---|---|---|
| 5,383,906 | A * | 1/1995 | Burchett | A61J 7/0046 | 222/133 |
| 5,638,968 | A * | 6/1997 | Baron | A61J 9/00 | 206/221 |
| 5,842,901 | A * | 12/1998 | Montgomery | A61J 9/00 | 446/77 |
| 6,109,100 | A * | 8/2000 | Buckley | A61J 9/00 | 604/76 |
| 2007/0017890 | A1* | 1/2007 | Al-Jadh | A61J 9/00 | 215/11.1 |
| 2017/0049663 | A1* | 2/2017 | Arends | A61J 9/001 | |
| 2018/0140510 | A1* | 5/2018 | Maldonado | A61J 1/1406 | |

* cited by examiner

*Primary Examiner* — Jeffrey R Allen
(74) *Attorney, Agent, or Firm* — Hayes Soloway PC

(57) ABSTRACT

There is provided a smart baby bottle for preventing tooth decay in infants, including a first compartment containing a first liquid (such as milk), a second compartment containing a second liquid (such as water), and an electrical two-way solenoid valve for controlling a flow of the second liquid from the second compartment into the first compartment. The baby bottle also includes a pacifier which can be mounted interchangeably to both compartments as needed. The solenoid valve receives electrical signals from a plurality of electrical sensors. The electrical two-way solenoid valve automatically opens and allows flow of water from the second compartment into the first compartment, when milk contained in the first compartment is completely finished by an infant. Hence, the infant's teeth are rinsed with the water subsequent to milk—thereby reducing tooth decay in infants considering that there will be reduced exposure to liquids containing sugar.

19 Claims, 6 Drawing Sheets

SMART BABY BOTTLE TO PREVENT TOOTH DECAY IN INFANTS

FIELD OF THE INVENTION

The present invention relates to a smart baby bottle, and more particularly a baby bottle designed to prevent tooth decay in infants.

BACKGROUND OF THE INVENTION

Baby Bottle Tooth Decay (BBTD) is a preventable dental disease which affects the upper primary incisors followed by the primary molars of infants. BBTD is one type of tooth decay that is common in bottle fed babies and can result in pain, infection and tooth extractions. The exposure of sweet liquids like natural sugars with milk to an infant's tooth for long periods is the primary cause of BBTD. Babies who are bottle-fed to sleep have a 15% chance of developing BBTD due to the long exposure to sugar. This is because bacteria in the mouth of an infant, grow on sugars, producing lactic acid waste, which destroy baby's teeth.

The prevalence of BBTD among babies has increased as few mothers are breastfeeding their child until the age of one. Studies have shown that mother's milk has immunity towards bacteria, thus preventing the teeth to decay. Research has shown that 49% of mother's breastfeed their babies until they are 6 months and only 27% of mothers breastfeed their babies until the ideal one year. Therefore, 73% of babies are being fed with formula using a feeding bottle. Globally, around 42% of children including 2 to 11 year olds deal with tooth decay, 15% of which is entirely caused by Baby Bottle Tooth Decay (BBTD). BBTD is also known as dental caries, a breakdown of teeth due to acids made by bacteria. An interaction between three primary variables contribute to such decay, which include cariogenic microorganisms within the mouth, fermentable carbohydrates and tooth surfaces that are susceptible to acid dissolution. Examples of cariogenic bacteria include '*Streptococcus Mutans*' or *S.Mutans*. These grow in an infant's mouth through sugar from milk or drinks, producing organic acids, such as lactic acid and acetic acid, which harm or decay different layers of the teeth (enamel, dentin and pulp).

Studies have shown that sucrose and other simple sugars such as glucose promote bacteria growth, which in an infant's mouth will produce organic acids such as lactic acid and acetate acid that rot the teeth and consequently cause tooth decay. Moreover, research has shown that microorganisms responsible for dental caries can also be transmitted from one individual to another, such as from mother to infant unknowingly. The effect of bacteria on tooth decay is detrimental as there are more bacteria in a mouth than there are human beings on earth. Although most of these bacteria are harmless to humans, some pose a serious threat to our oral health. Several studies have indicated that whilst the infant is sleeping, the flow of saliva in the mouth reduces and subsequently prevents the remaining food to be carried down the throat to be digested in the stomach. As a result, the sugars stay on the infant's teeth for an extended period, therefore giving the bacteria in the infant's mouth more time to eat, digest, and release their harmful acids, and eventually grow in population. A sleep-time bottle, constant daytime sipping from a bottle or sippy cup containing anything other than water and frequent snacking are practices linked to the development of extensive caries, and thus the prevalence of microorganisms in such cases is a popular cause of Baby Bottle Tooth Decay (BBTD).

This condition can affect children before the young age of one. BBTD is painful, and can influence an infant's ability to eat properly, sleep through the night, grow and develop normally, and thus achieve full potential. Therefore, the misconception that an infant's primary teeth are not very important as they drop out in the ages of five to seven must be eliminated, since primary teeth are required for development such as chewing food, speaking correctly and smiling in the early years. Furthermore, caries in primary (baby) teeth have a significant and positive association with caries and malalignment of permanent teeth. Primary teeth erupt before thirty-three months, and will drop off before the infant is twelve years of age, prior to which the permanent teeth have already come out in the place of the primary teeth. This is because the partial falling or rotting of a tooth may stimulate a permanent tooth to grow out, to take its place, causing very crooked, unarranged teeth. Therefore, it is likely that an infant will develop bad eating habits and speaking problems if the primary teeth of the infant are damaged, in comparison to those children who have better hygiene.

As a result of the above, multiple smart baby bottles have been developed to deliver better oral hygiene. There is a growing emphasis on prevention of ill-health and in preventing diseases. For these reasons, efforts towards reducing the quantity of sugar intake through liquids have been traditionally tested. Further efforts demonstrate feeding bottles that have been designed to maintain the milks warm temperature, others measure the optimum angle at which the milk must be drunk from. Bottles have also been designed to measure statistics of fluid intake such as the time taken to drink the bottled milk or the amount of milk.

Accordingly, there exists a need for a baby bottle design, which protects an infant's teeth from decay and effectively supports oral hygiene in infants or children.

SUMMARY OF THE INVENTION

Therefore it is an object of the present invention to develop a smart baby bottle designed to prevent tooth decay in infants.

The present invention involves a smart baby bottle for preventing tooth decay in infants, the smart baby bottle comprising a first compartment containing a first liquid, a second compartment containing a second liquid and a solenoid valve for controlling a flow of the second liquid from the second compartment into the first compartment, wherein the solenoid valve receives electrical signals from a plurality of electrical sensors.

In an embodiment of the present invention, the solenoid valve is an electrical two-way solenoid valve.

In an embodiment of the present invention, the electrical two-way solenoid valve automatically opens and allows flow of the second liquid from the second compartment into the first compartment, when the first liquid contained in the first compartment is finished.

In an embodiment of the present invention, the first liquid is milk, comprising two-thirds by volume of the smart baby bottle.

In an embodiment of the present invention, the second liquid is water, comprising one-thirds by volume of the smart baby bottle.

In an embodiment of the present invention, the first compartment is positioned on top of the second compartment.

In an embodiment of the present invention, the solenoid valve is located between the first and second compartments.

In an embodiment of the present invention, an infant's teeth are rinsed with water from the second compartment once milk from the first compartment is completely drunk by the infant.

In an embodiment of the present invention, a battery provides power to the solenoid valve.

In an embodiment of the present invention, an electric switch enables tuning of the solenoid valve.

In an embodiment of the present invention, the smart baby bottle further comprises electrical sensors for detecting a level of the first liquid, and sending electrical signals to the solenoid valve on detecting that the first liquid has finished.

In an embodiment of the present invention, the solenoid valve automatically opens and allows the second liquid to flow into the first compartment on receiving electrical signals from the electrical sensors.

In an embodiment of the present invention, electrical signals sent from the electrical sensors use a current of 0.1 mA thereby causing no harm to the infant.

In an embodiment of the present invention, the electrical sensors comprise liquid level sensors for detecting a presence or level of liquids within the first and second compartments of the smart baby bottle.

In an embodiment of the present invention, the electrical sensors are capacitive liquid level sensors.

In an embodiment of the present invention, the smart baby bottle further comprises an accelerometer for detecting an angular position of the smart baby bottle.

In an embodiment of the present invention, the smart baby bottle further comprises a BLUETOOTH module in communication with external mobile devices.

In an embodiment of the present invention, the BLUETOOTH module sends alerts to mobile devices of parents, when level of the first liquid contained within the first compartment remains unchanged for a particular period of time.

In an embodiment of the present invention, the smart baby bottle further comprises a programmable circuit board or microcontroller.

In an embodiment of the present invention, the smart baby bottle further comprises an outer plastic casing enclosing the first and second compartments and electrical components of the smart baby bottle.

As a further aspect of the invention, there is provided a smart baby bottle for rinsing an infant teeth after consumption of milk, the smart baby bottle comprising:

- a first compartment for containing milk;
- a second compartment for containing a rinsing liquid;
- a pacifier for being interchangeably coupled to the first compartment or to the second compartment as required;
- a liquid detector for determining a liquid status comprising presence/absence of milk inside the first compartment;
- an angular detector for determining an angular position of the baby bottle;
- a valve in fluid communication with the second compartment for controlling the fluid communication of the rinsing liquid;
- a communication unit in wireless communication with an external computing unit for communicating a status of the baby bottle or the infant;
- a microprocessor in electrical communication with the liquid detector, the angular detector, the valve and the communication unit; and
- a battery for providing electrical power to the liquid detector, angular detector, valve, microprocessor and communication unit;

wherein the microprocessor receives output signals from the liquid detector and the angular detector about the liquid status of the milk and the angular position of the baby bottle respectively, processes said output signals based on preconfigured criteria, and controls operation of the valve and the communication unit based on said determination.

In an embodiment of the invention:

- The pacifier is coupled to the first compartment and in fluid communication therewith;
- the second compartment is in fluid communication with the first compartment through the valve for communicating the rinsing liquid from the second compartment to the first compartment;
- the microprocessor controls the valve to open for passing the rinsing liquid from the second compartment to the first compartment for communication to the infant through the pacifier when the liquid detector determines absence of the milk in the first compartment and the when the angular detector determines that the baby bottle is a drinking position.

In an embodiment of the invention, the microprocessor determines a sleeping status of the infant and sends a sleeping notification to the external computing unit through the communication unit when the angular position detector determines a spontaneous change in the angular position of the baby bottle from a drinking position to a falling position while the milk is still present in the first compartment as determined by the liquid detector.

In an embodiment of the invention, the microprocessor sends a notification to the external computing unit through the communication unit for changing the location of the pacifier from the first compartment to the second compartment in order to rinse the teeth of the infant with the rinsing liquid when the microprocessor determines through the output signals of the angular position detector and the liquid detector that the baby bottle has ceased to be in a drinking position while the milk is still present in the first compartment.

In an embodiment of the invention, the valve is a two-way solenoid valve for allowing communication of the rinsing liquid with a sufficient water pressure for the rinsing liquid to reach a mouth of the infant.

In an embodiment of the invention, the first compartment is two-thirds by volume of the smart baby bottle.

In an embodiment of the invention, the second compartment is one-third by volume of the smart baby bottle.

In an embodiment of the invention, the first compartment extends from a first end to a second end and is adapted to be removably coupled to the pacifier at the first end and to the valve at the second end, and wherein the second compartment extends from a third end to a fourth end and is adapted to be removably coupled to the pacifier at the fourth end and to the valve at the third end.

In an embodiment of the invention, the valve is located intermediate the first and second compartments.

In an embodiment of the invention, wherein the rinsing liquid is water.

In an embodiment of the invention, the smart baby bottle further comprising an electric switch in electrical connection with the valve for manually switching the valve in an on and off position.

In an embodiment of the invention, the liquid detector comprises electrical sensors.

In an embodiment of the invention, the electrical sensors comprise capacitive liquid sensors.

In an embodiment of the invention, the angular position detector comprises an accelerometer and a sensor.

In an embodiment of the invention, the angular position detector comprises at least two sensors.

In an embodiment of the invention, the electrical sensors use a current of 0.1 mA thereby for causing no harm to the infant.

In an embodiment of the invention, the communication unit comprises a BLUETOOTH module and wherein the external computing unit is a mobile device.

In an embodiment of the invention, a notification is sent to the external computing unit when a level of the first liquid contained within the first compartment remains unchanged for a predefined period of time which is an indication that the infant is not drinking the milk.

In an embodiment of the invention, the smart baby bottle further comprises an outer plastic casing for enclosing the first and second compartments and electrical components of the smart baby bottle.

BRIEF DESCRIPTION OF THE DRAWINGS

The subject matter that is regarded as the invention is particularly pointed out and distinctly claimed in the claims at the conclusion of the specification. The foregoing and other aspects, features, and advantages of the invention are apparent from the following detailed description taken in conjunction with the accompanying drawings in which:

DETAILED DESCRIPTION OF THE INVENTION

Figure 1:
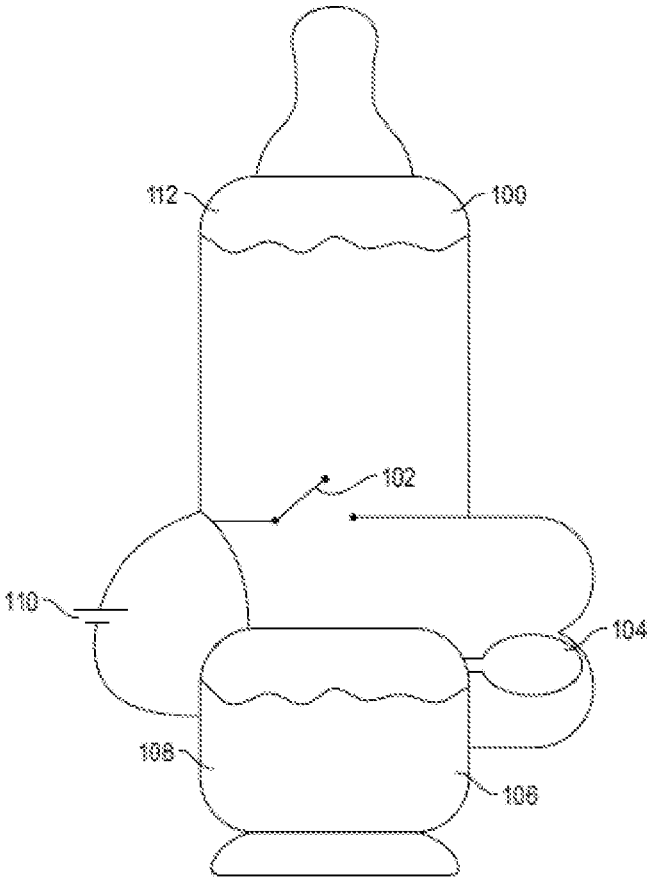
FIG. 1 illustrates a basic design of the smart baby bottle, in accordance with the present invention.

The aspects of the device or system for prevention of tooth decay within infants utilizing a smart baby bottle design according to the present invention will be described in conjunction with FIGS. 1-4. In the Detailed Description, reference is made to the accompanying figures, which form a part hereof, and in which is shown by way of illustration specific embodiments in which the invention may be practiced. It is to be understood that other embodiments may be utilized and logical changes may be made without departing from the scope of the present invention. The following detailed description, therefore, is not to be taken in a limiting sense, and the scope of the present invention is defined by the appended claims.

The proposed solution aims at designing a smart baby bottle, which will clean an infant's teeth with water once milk has been drunk from the smart baby bottle. The ultimate goal is to develop a device that will help parents to take better care of their children's teeth every time their child drinks a bottle of milk. More specifically, the present invention resolves baby bottle tooth decay by preventing exposure of teeth to liquids containing sugars, which would otherwise allow for bacteria to grow on the teeth uncontrollably. This is because bacteria in the mouth thrive on such sugars and make acids that attack the teeth. Baby bottle tooth decay is characterized by a distinctive pattern of tooth decay in the primary dentition. The four maxillary incisors are most frequently affected, while the four mandibular incisors usually remain unaffected. Explanations for this pattern include the pooling of milk or sweetened liquid from the feeding bottle around the maxillary incisors and other teeth of a sleeping infant as the main etiologic factor. A common preventive approach is to eliminate sugar traces contained in most liquids from an infant's mouth after feeding. This may be achieved by rinsing a baby's mouth with water after feeding, and therefore reduce tooth decay in infants as there will be no long exposures to liquids containing sugar.

In accordance with the present invention, in order to protect the teeth against bacteria, the effect of milk on teeth was studied. The research consisted of three different tasks entailing three hypotheses. Firstly, it was expected that teeth exposed to milk without cleaning with water will decay faster than those cleaned with water. Secondly, it was assumed that more bacteria will be present on the teeth with the highest exposure to milk, and thirdly it was expected that a smart baby bottle with a water cleaning feature will allow less decay of an infant's teeth. In order to test these hypotheses, three tasks were undertaken which allowed the objectives of this present invention to be studied. The specific objectives were to study an effect of milk on teeth, in order to measure the level of bacteria present on teeth exposed to milk, and subsequently to develop a smart baby bottle that prevents the risk of developing tooth decay in infants or children.

In accordance with an embodiment of the present invention, in order to investigate the effect of milk on teeth over a period of two months, goat teeth were used in an experiment to give close-to accurate results to humans. Elemental analyses performed by the University of Murcia indicate that human and bovine enamel and dentine show greatest similarity among a number of species analyzed. The apparatus and components used for this experiment comprised of baby milk powder (PediaSure Complete and Balanced Nutrition) to test effect of sugar on the teeth, four glass beakers to contain milk and teeth, water to dissolve milk and clean teeth, goat teeth (of a one year old infant) to study the effect of milk on tooth decay, mixing spoon to mix dry powder with water, towel to dry off teeth after washing, name tags for labelling samples, measuring syringe to measure desired water amount, mixing cup to mix dry powder with water, timer (stopwatch) to measure time intervals, and a camera to take pictures of the affected and unaffected teeth. The beakers containing the milk and goat teeth are illustrated in FIG. 2.

In the experiment, four sample groups were prepared and studied. An illustration of these sample groups are shown in FIGS. 2(*a*), 2(*b*) and 2(*c*). A first sample (control or reference) comprised of teeth being simply placed in the beaker and left alone, labelled as 'None'. A second sample consisted of only water, wherein the teeth in this category were rinsed with water and labelled 'Water'. A third sample entailed solely milk, and the teeth in this category were exposed to milk and labelled as 'Milk', and the fourth sample was exposed to both milk and water, wherein the teeth were exposed to milk and rinsed with water after 15 minutes. This fourth sample was labelled 'Milk and Water'.

In accordance with another embodiment of the present invention, the method employed to identify the effect of water, milk, and the combination of both on teeth, included that the beaker 212 labelled 'None' was remained untouched. 40 ml of water was mixed with a levelled scoop of milk powder, using the provided measuring spoon in the milk powder container, Wherein half of the milk solution prepared was added to the beaker 210 labelled as 'Milk', and the other half to the beaker 206 labelled as 'Milk and Water'. Further, the samples from the above step were left within the milk for 15 minutes, subsequent to which the milk from the beaker 210 was poured out. The milk from beaker 206 labelled as 'Milk and Water' was poured out and the teeth were cleaned three times each with 50 ml of water. For the 'Water' beaker 204, the teeth 220 contained in beaker 204 labelled as 'Water' were also cleaned three times each with 50 ml of water. All of the above explained steps were repeated three times a day (at 7 am, 5 pm, and 10 pm) for a period of two months. Every week, the teeth in all four beakers were completely rinsed with water, dried with the towel, and placed back into their respective beakers, After each month, the teeth were taken out of their beakers, completely rinsed and photographed to analyze the results.

Figure 2B:
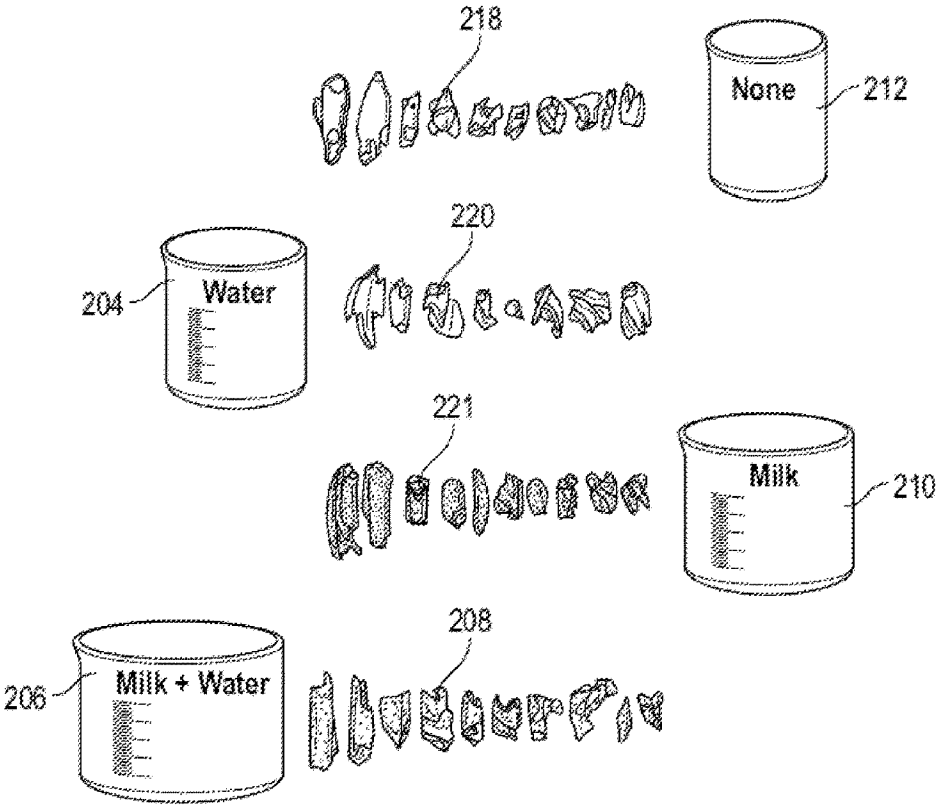
FIGS. 2 (*a*), 2 (*b*) and 2 (*c*) displays results of an experiment conducted to determine the effect of milk on teeth.
Figure 2A:
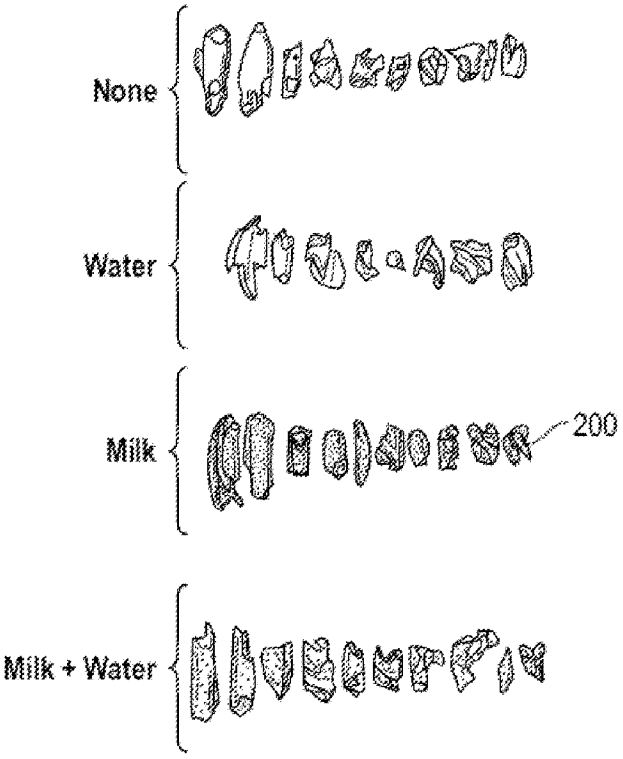
Figure 2C:
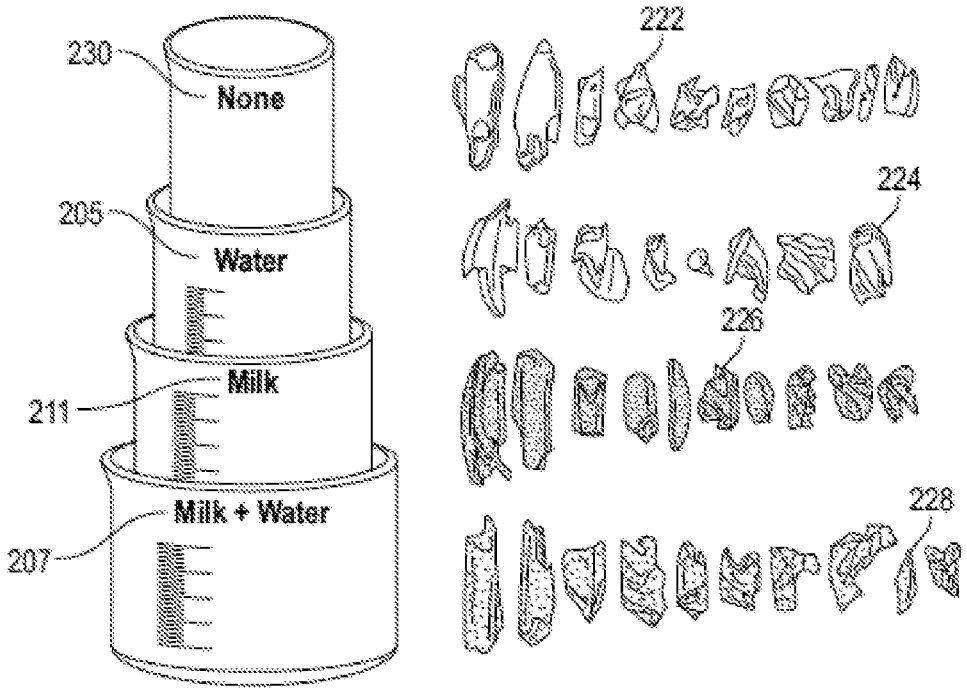

In accordance with the present invention, results of the experiment conducted in order to determine the effect of milk on teeth is also illustrated in FIGS. 2(*a*), 2(*b*) and 2(*c*). On day one of the experiment all the teeth 200 were the same colour (mostly white), as they were new and had not been experimented (see FIG. 2(*a*)). After one month (see FIG. 2(*b*)), the teeth 218 exposed to beaker 212 labelled 'None' and the teeth 220 exposed to beaker 204 labelled 'Water' had not changed colour at all due to no sugar exposure on the teeth. But the teeth 221 exposed to beaker 210 labelled 'Milk' had a visible change in colour to visible yellow due to being coated in a thin layer of sugary milk. This allows the bacteria to feed off the sugars and grow on the teeth, excreting acidic waste products, decaying the tooth. Moreover, the teeth 208 exposed to beaker 206 labelled 'Milk and Water' had a very minimal, negligible change in colour, barely visible. This is because most of the sugars lying on the teeth for 15 minutes will have been washed away by water. However, some milk will still be left on the teeth, allowing bacteria to continuously grow on the teeth without disturbance, over periods of rest, thus resulting in a slight colour change. After two months (See FIG. 2(*c*)), teeth 222 exposed to beaker 230 labelled 'None' and the teeth 224 exposed to beaker 205 labelled 'Water' still had not changed colour at all, due to no sugar exposure of the teeth. The teeth 226 exposed to beaker 211 labelled 'Milk' had significantly changed colour compared to the results from the first month. They became very yellow, more closely resembling brown in coloration. They were rotten and the change of colour was dramatic mainly because of the already existing bacteria groups having sugar to feed on, multiply, and ultimately accelerating the rate of the teeth decay. The teeth 228 exposed to beaker 207 labelled 'Milk and Water' had experienced some colour change, however, its colour change was much less yellow or brown than that of the teeth 226 exposed to beaker 211 labelled 'Milk'. The slightly visible color change to slight yellow is most likely due to the exposure of bacteria on the teeth to small amounts of leftover sugars, which they could feed on, and multiply, but at a much slower rate than the teeth 226 exposed to beaker 211 labelled 'Milk'.

In accordance with the present invention, the effect that milk has on teeth is explained through the observation of photographs taken during the above elaborated experiment. Rinsing the teeth three times (with 50 ml water each time) had a significant effect on the outcome of the tooth, as seen in FIG. 2 (*c*), regarding the colour and the level of decay. Also, it is evident that as the teeth decayed, the teeth colour changed more and more towards the yellow, or brown colors. However, in reality this cannot be possible as salivary glands within the mouth, though less when asleep, still produce saliva, a watery fluid, into the mouth, onto the teeth and down the throat. Therefore, it will never occur that an infant's teeth are covered with thin layer of sugary milk powder throughout the entire night, as the infant's saliva will quickly wash away and clean most of the sugars off the teeth. However, some sugar is still likely to remain, which is what the bacteria feeds on, therefore decaying the tooth. Accordingly, washing teeth with water subsequent to drinking milk helps prevent infant teeth from decay. The study with goat teeth showed significantly less change in colour when the teeth were rinsed with water after drinking milk. Since decay is a slow process, the study was expedited to be able to observe significant difference among studied samples within a couple of weeks.

Figure 5:
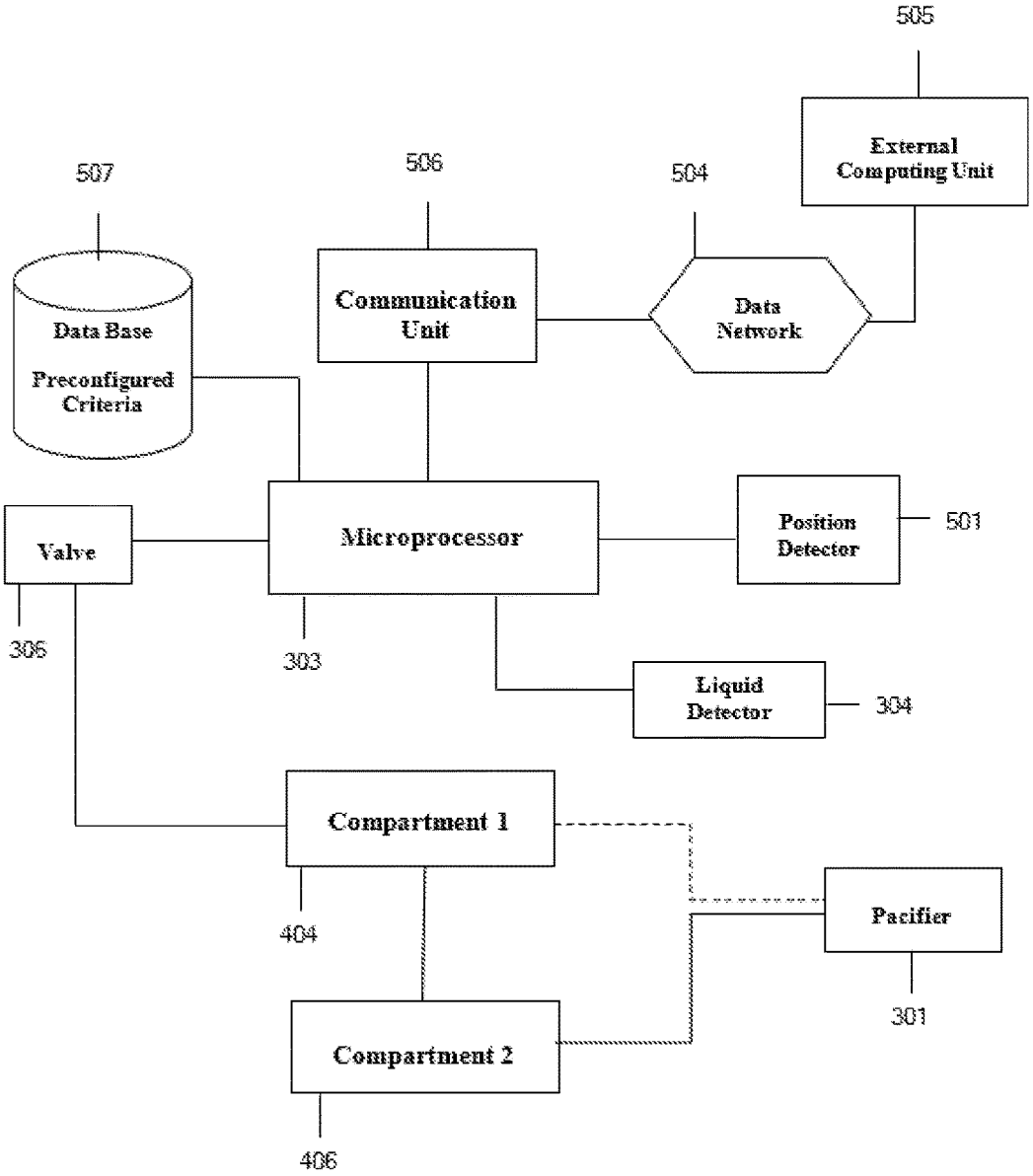
FIG. 5 a block diagram of a smart baby bottle device in accordance with an embodiment of the invention.

In accordance with a preferable embodiment of the present invention, the smart baby bottle designed to prevent tooth decay includes a cleaning water feature which aids to reduce the risk of Baby Bottle Tooth Decay (BBTD). The initial design of the smart baby bottle is depicted in FIG. 1, wherein the main components of the baby bottle are highlighted. The main components of the smart baby bottle design comprise of a first compartment 112, containing milk 100 and the second compartment 106, containing water 108. Between these two compartments is a solenoid valve 104 that will allow the flow of water. A battery 110 will provide electrical power to the electrical sensors (liquid detector), 304 accelerometer (angular detector) 501, solenoid valve 104, microprocessor 303, communication unit 506, and an electric switch 102 that will enable one to tune the solenoid valve 104 on or off manually. The microprocessor 303 is in electrical communication with the liquid detector, the angular detector, the valve and the communication unit 506. The communication unit 506 is in wireless communication with the external computing unit 505 for communicating the status of the baby bottle 300 or the infant. The microprocessor receives output signals from the liquid detector and the angular detector about the liquid status of the milk and the angular position of the baby bottle respectively, processes said output signals based on preconfigured criteria 507, and controls operation of the valve and the communication unit based on said determination as illustrated in FIG. 5. This is the basic concept behind the smart baby bottle design, as per the present invention.

In accordance with another embodiment of the present invention, four different prototypes were developed and tested in order to arrive at an optimized smart baby bottle design. The initial baby bottle prototype consisted of a one-way solenoid valve, wherein the one-way solenoid valve allowed flow of fluid only in one direction when open. However, this one-way solenoid valve required a pressure of at least 3 psi in order to open, and since a small column of water could not exert 3 psi pressure—there was not enough pressure on the one-way solenoid valve to open. Thus this prototype was not successful and feasible. Further, a second prototype was designed using a two-way solenoid valve, which allowed fluid flow from both sides when open and did not require an additional pressure to initiate the flow.

Figure 3:
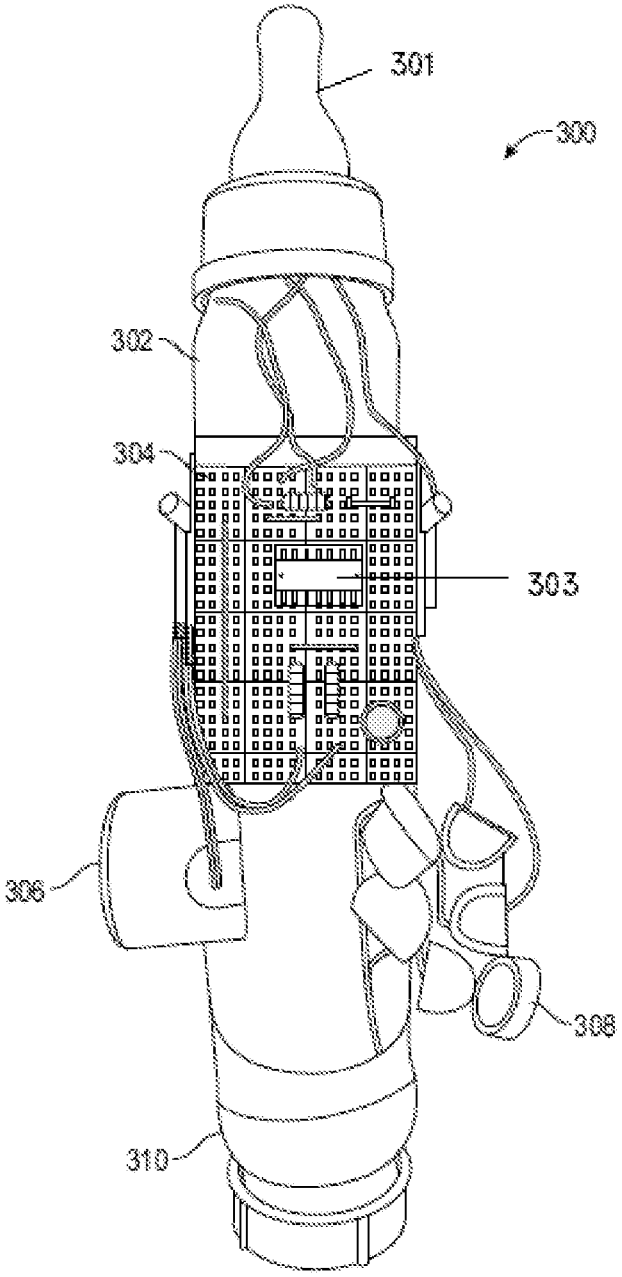
FIG. 3 depicts the smart baby bottle comprising of a two-way solenoid valve, in accordance with the present invention.

In accordance with the present invention and as illustrated in FIG. 3, the components required for designing the smart baby bottle mainly include a baby bottle 300 comprising of two separate compartments—the first compartment 302, containing milk (two-thirds by volume) and the second compartment 310, containing water (one-thirds by volume). Further components include a plurality of wires to connect electric parts, a two-way solenoid valve 306 to open and close a gate between the first compartment 302 and the second compartment 310, electric sensors 304, a battery 308 to provide power to the two-way solenoid valve 306 and electric sensors 304.

The third prototype, as illustrated in FIG. 3 included the two-way solenoid valve 306 and an automatic valve-opening system—which automated the system allowing it to work without the need of someone physically opening the solenoid valve by a switch. The two-way solenoid valve 306 automatically opened when milk contained within the first compartment 302 was finished. Electrical sensors implemented into the model further supported this automated feature. Considering the electrical implementation of this final prototype, a plurality of electrical wires are connected to a circuit board 304, which further includes an inverter, a transistor, and resistors. This electrical combination allows the two-way solenoid valve 306 to automatically open once the milk has drained out completely from the first compartment 302.

In accordance with a preferable embodiment of present invention, the proposed system to protect teeth of infants or children from tooth decay incorporates an electrical two-way solenoid valve 306 between the first compartment 302 and second compartment 310 containing the milk and water respectively, which opens, releasing water once the infant has finished drinking milk. Electrical sensors 304 located at certain points in the baby bottle 300 detects when the milk has finished and sends an electrical message to the two-way solenoid valve 306, thereby opening it and allowing water to slowly pass through the two-way solenoid valve 306, reaching the infant's mouth. An angular position detector 501 comprising an accelerometer and a sensor detects the position of the smart baby bottle 300 to determine whether the baby bottle is standing upright, e.g. on a table or if the bottle is upside down in the infant's mouth. An angular position of the baby bottle is detected by the accelerometer, which determines whether the two-way solenoid valve 306 should allow water to flow down or not. In case an accelerometer is used then only one electric sensor is required, at the top of the first or milk compartment 302, but if an accelerometer is not used then two electric sensors are required in the first or milk compartment 302; one at the top and the other at the bottom of the first compartment 302.

Figure 4:
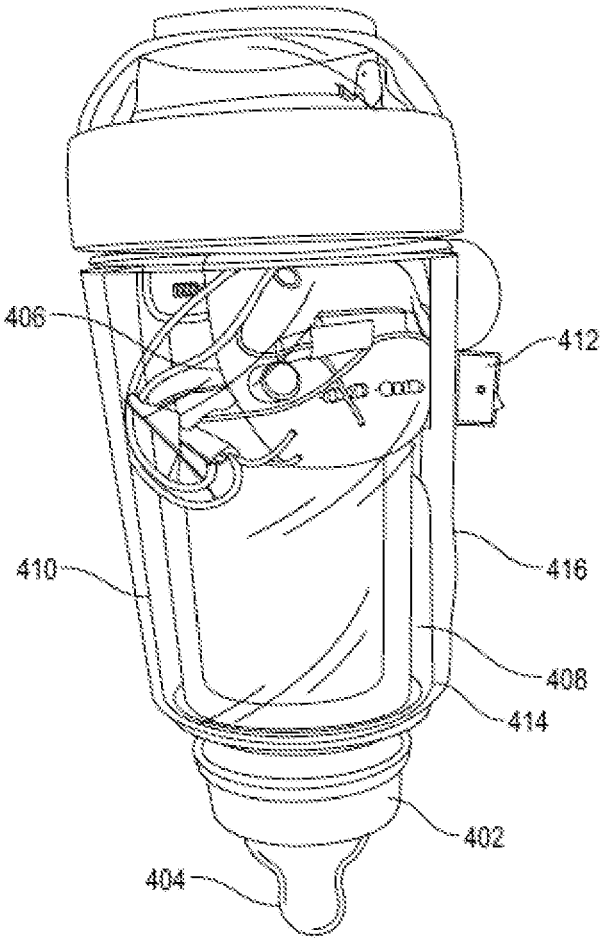
FIG. 4 depicts the smart baby bottle comprising of an outer plastic casting, in accordance with the present invention.

A fourth prototype, as illustrated in FIG. 4, was designed similar to the third prototype but including an outer plastic casing 402. This baby bottle design also has an automatic cleaning feature, however uses a smaller and more compact circuit board 408 capable of being placed into the plastic outer cover 402, along with 12V batteries 410 and the baby bottle 412 itself. Additionally, this final design also includes a BLUETOOTH module 504, an accelerometer and a programmable circuit board or microcontroller (like Arduino). In another embodiment of the present invention, this final design further allows to identify whether an infant has fallen asleep through detecting sudden changes of the accelerometer reading. This identification will allow the system to inform parents that the infant has fallen asleep and that it is required to manually switch sides of the baby bottle in order for the infant to drink water to clean his/her teeth. With consideration to the health and safety aspect of the implemented design, since current between capacitors is negligible this causes no harm towards an infant drinking from the smart baby bottle In FIG. 4, the smart baby bottle 412 includes an outer plastic casing 402, wherein, a compact circuit board 408 is present, thereby reducing the size of the baby bottle 412. Additional components include an electric switch to manually tune the two-way solenoid valve 416 on or off, an accelerometer (not shown) to detect whether the baby bottle 412 is standing upright or upside down, a liquid or water sensor to detect the presence or level of water in the baby bottle 412 and a capacitive liquid level sensor to detect the level of milk in the first compartment 404. Also included is an Arduino (a programmable circuit board or microcontroller) to detect levels of milk detected by capacitive liquid level sensor to control opening of the two-way solenoid valve 416, and finally a BLUETOOTH device 504. The relevance of the BLUETOOTH device 504 in accordance with the present invention is that parents are informed through BLUETOOTH technology when the infant has stopped drinking the milk (due to reasons such as the infant falling asleep). This can be indicated when no change in the levels of milk are detected over a given period of time (1-2 minutes). As a result, on receiving an indication, parents can manually switch the direction of the baby bottle, by putting the pacifier 301 to the water container, allowing the infant to drink the water. The pacifier is 301 interchangeably coupled to the first compartment or to the second compartment as required. In another embodiment of the present invention, two types of electric sensors are used in the baby bottle design. The first type is made of electric wires and placed within the outer plastic casing 402 (as illustrated in FIG. 4), and another type of sensors are based on the measurement of milk capacitance, and will be placed outside the milk bottle.

In accordance with another embodiment of the present invention, a smart baby bottle design was successfully developed comprising an automated water rinsing feature to prevent tooth decay. The smart baby bottle rinses the infant's teeth with water once the infant has finished drinking milk. The smart baby bottle includes electric sensors to automate the release of water from the second water compartment 406. Designing a smart baby bottle model to reduce the risk of baby bottle tooth decay (BBTD) entails reduced size of electrical components (such as two-way solenoid valves 416, batteries 410, and switch 414), in order to reduce the weight of the prototype and thus have a lighter feeding bottle, putting less stress on the infant's teeth.

In accordance with another embodiment of the present invention, an added advantage and practicality of this smart baby bottle is to notify parents of the child's feeding activities via BLUETOOTH. If the child has fallen asleep before drinking enough milk, the parent can prompt continuation of milk intake or switch the sides of the bottle to rinse the baby's teeth. This is possible as the smart baby bottle comprises a liquid capacitor sensor to detect unchanging water levels. The Arduino (a programmable circuit board or microcontroller) which, are connected to the liquid or water capacitor sensor, recognize this, sending a message to the parent, via BLUETOOTH to an app on the user's phone. This notifies parents to open the two-way solenoid valve and release the water to wash the baby's teeth. As a result, monitoring the child is not required, offering convenience to the parents.

In accordance with another embodiment of the present invention, a stand (not shown) is included in the overall design on which the smart baby bottle is held while the infant is drinking milk, this will help to reduce pressure of weight on the infant's teeth. This will also reduce the stress of the young infant having to hold the bottle, considering cases where a reduced size and weight of the electrical components are not enough to allow an infant to safely and comfortably hold the smart baby bottle.

Many changes, modifications, variations and other uses and applications of the subject invention will become apparent to those skilled in the art after considering this specification and the accompanying drawings, which disclose the preferred embodiments thereof. All such changes, modifications, variations and other uses and applications, which do not depart from the spirit and scope of the invention, are deemed to be covered by the invention, which is to be limited only by the claims which follow.

The invention claimed is:

1. A smart baby bottle for rinsing an infant's teeth after consumption of milk, the smart baby bottle comprising:

a first compartment for containing milk;

a second compartment for containing a rinsing liquid;

a pacifier for being interchangeably coupled to the first compartment or to the second compartment as required;

a liquid detector for determining a liquid status comprising presence/absence of milk inside the first compartment;

an angular detector for determining an angular position of the baby bottle;

a valve in fluid communication with the second compartment for controlling the fluid communication of the rinsing liquid;

a communication unit in wireless communication with an external computing unit for communicating a status of the baby bottle or the infant;

a microprocessor in electrical communication with the liquid detector, the angular detector, the valve and the communication unit; and a battery for providing electrical power to the liquid detector, angular detector, valve, microprocessor and communication unit;

wherein the microprocessor receives output signals from the liquid detector and the angular detector about the liquid status of the milk and the angular position of the baby bottle respectively, processes said output signals based on preconfigured criteria, and controls operation of the valve and the communication unit based on the output signals and the preconfigured criteria.

2. The smart baby bottle of claim 1, wherein:

The pacifier is coupled to the first compartment and in fluid communication therewith;

the second compartment is in fluid communication with the first compartment through the valve for communicating the rinsing liquid from the second compartment to the first compartment;

the microprocessor controls the valve to open for passing the rinsing liquid from the second compartment to the first compartment for communication to the infant through the pacifier when the liquid detector determines absence of the milk in the first compartment and when the angular detector determines that the baby bottle is a drinking position.

3. The smart baby bottle of claim 2, wherein the microprocessor determines a sleeping status of the infant and sends a sleeping notification to the external computing unit through the communication unit when the angular position detector determines a spontaneous change in the angular position of the baby bottle from a drinking position to a falling position while the milk is still present in the first compartment as determined by the liquid detector.

4. The smart baby bottle of claim 2, wherein the microprocessor sends a notification to the external computing unit through the communication unit for changing the location of the pacifier from the first compartment to the second compartment in order to rinse the teeth of the infant with the rinsing liquid when the microprocessor determines through the output signals of the angular position detector and the liquid detector that the baby bottle has ceased to be in a drinking position while the milk is still present in the first compartment.

5. The smart baby bottle of claim 1, wherein the valve is a two-way solenoid valve for allowing communication of the rinsing liquid with a sufficient water pressure for the rinsing liquid to reach a mouth of the infant.

6. The smart baby bottle as claimed in claim 1, wherein the first compartment is two-thirds by volume of the smart baby bottle.

7. The smart baby bottle as claimed in claim 1, wherein the second compartment is one-third by volume of the smart baby bottle.

8. The smart baby bottle as claimed in claim 1, wherein the first compartment extends from a first end to a second end and is adapted to be removably coupled to the pacifier at the first end and to the valve at the second end, and wherein the second compartment extends from a third end to a fourth end and is adapted to be removably coupled to the pacifier at the fourth end and to the valve at the third end.

9. The smart baby bottle as claimed in claim 1, wherein the valve is located intermediate the first and second compartments.

10. The smart baby bottle as claimed in claim 1, wherein the rinsing liquid is water.

11. The smart baby bottle as claimed in claim 1, further comprising an electric switch in electrical connection with the valve for manually switching the valve in an on and off position.

12. The smart baby bottle as claimed in claim 1, wherein the liquid detector comprises electrical sensors.

13. The smart baby bottle as claimed in claim 12, wherein the electrical sensors comprise capacitive liquid sensors.

14. The smart baby bottle as claimed in claim 1, wherein the angular position detector comprises an accelerometer and a sensor.

15. The smart baby bottle as claimed in claim 1, wherein the angular position detector comprises at least two sensors.

16. The smart baby bottle as claimed in claim 15, wherein the electrical sensors use a current of 0.1 mA thereby for causing no harm to the infant.

17. The smart baby bottle as claimed in claim 1, wherein the communication unit comprises a BLUETOOTH module and wherein the external computing unit is a mobile device.

18. The smart baby bottle as claimed in claim 1, wherein a notification is sent to the external computing unit when a level of the first liquid contained within the first compartment remains unchanged for a predefined period of time which is an indication that the infant is not drinking the milk.

19. The smart baby bottle as claimed in claim 1, wherein the smart baby bottle further comprises an outer plastic casing for enclosing the first and second compartments and electrical components of the smart baby bottle.

* * * * *